US011786903B2

(12) United States Patent
Laugharn, Jr. et al.

(10) Patent No.: US 11,786,903 B2
(45) Date of Patent: Oct. 17, 2023

(54) MULTI-COMPONENT SAMPLE HOLDER

(71) Applicant: Covaris, LLC, Woburn, MA (US)

(72) Inventors: James A. Laugharn, Jr., Boston, MA (US); Jeremy Terry, Wilmington, MA (US); Todd Anthony Basque, West Newbury, MA (US)

(73) Assignee: Covaris, LLC, Woburn, MA (US)

( * ) Notice: Subject to any disclaimer, the term of this patent is extended or adjusted under 35 U.S.C. 154(b) by 266 days.

(21) Appl. No.: 17/198,640

(22) Filed: Mar. 11, 2021

(65) Prior Publication Data

US 2021/0291169 A1 Sep. 23, 2021

Related U.S. Application Data

(60) Provisional application No. 62/990,680, filed on Mar. 17, 2020.

(51) Int. Cl.
*B01L 3/00* (2006.01)

(52) U.S. Cl.
CPC ..... *B01L 3/50855* (2013.01); *B01L 3/50851* (2013.01); *B01L 3/50853* (2013.01); *B01L 2300/04* (2013.01); *B01L 2300/0819* (2013.01); *B01L 2300/0832* (2013.01); *B01L 2300/0851* (2013.01); *B01L 2300/0858* (2013.01); *B01L 2300/12* (2013.01)

(58) Field of Classification Search
CPC ..... B01L 3/50855; B01L 3/50851; B01L 3/50853; B01L 2300/04; B01L 2300/0819; B01L 2300/0832; B01L 2300/0851; B01L 2300/12
See application file for complete search history.

(56) References Cited

U.S. PATENT DOCUMENTS

| | | | |
|---|---|---|---|
| 4,136,429 | A | 1/1979 | Brandes |
| 4,599,314 | A | 7/1986 | Shami |
| 4,659,222 | A | 4/1987 | Ekholm |
| 4,735,778 | A | 4/1988 | Maruyama et al. |
| 5,470,536 | A | 11/1995 | Järvimäki |
| 5,514,343 | A | 5/1996 | Verwohlt et al. |
| 5,916,526 | A | 6/1999 | Robbins |
| 6,051,191 | A | 4/2000 | Ireland |
| 6,103,169 | A | 8/2000 | Mathus et al. |
| 6,340,589 | B1 | 1/2002 | Turner et al. |
| 6,426,215 | B1 | 7/2002 | Sandell |
| 6,503,456 | B1 | 1/2003 | Knebel |
| 6,528,302 | B2 | 3/2003 | Turner et al. |
| 6,660,232 | B1 | 12/2003 | Krueger et al. |
| 7,037,580 | B2 | 5/2006 | Razavi et al. |
| 7,309,603 | B2 | 12/2007 | Ma et al. |
| 7,318,590 | B2 | 1/2008 | Razavi |

(Continued)

*Primary Examiner* — Jill A Warden
*Assistant Examiner* — Alex Ramirez
(74) *Attorney, Agent, or Firm* — Wolf, Greenfield & Sacks, P.C.

(57) ABSTRACT

A sample holder for holding a liquid sample for laboratory processing, such as PCR thermal cycling. The sample holder includes at least one vessel having a bottom and sidewall defining an interior volume and a rim defining an opening to the interior volume. The vessel has a first portion that defines at least a part of the bottom and sidewall of the vessel and is made of a first material, and a second portion that defines the rim of the vessel and is made of a second material different from the first material.

26 Claims, 3 Drawing Sheets

(56) References Cited

U.S. PATENT DOCUMENTS

| | | | | |
|---|---|---|---|---|
| 7,347,977 | B2 | 3/2008 | Guelzow et al. | |
| 7,674,346 | B2 | 3/2010 | Clements et al. | |
| 7,767,153 | B2 | 8/2010 | Guelzow et al. | |
| 7,993,548 | B2 | 8/2011 | Turner | |
| 8,221,697 | B2 | 7/2012 | Nichols et al. | |
| 8,591,791 | B2 | 11/2013 | Guelzow et al. | |
| 8,636,965 | B2 | 1/2014 | Lohn | |
| 8,802,000 | B2 | 8/2014 | Chu et al. | |
| 8,808,647 | B2 | 8/2014 | Cherubini et al. | |
| 9,168,532 | B2 | 10/2015 | Malinoski et al. | |
| 9,180,456 | B2 | 11/2015 | Malinoski et al. | |
| 2004/0065655 | A1* | 4/2004 | Brown | B01L 3/50853 219/385 |
| 2004/0214315 | A1 | 10/2004 | Saluz et al. | |
| 2006/0024204 | A1 | 2/2006 | Oldenburg | |
| 2007/0031296 | A1 | 2/2007 | Coulling et al. | |
| 2011/0123415 | A1 | 5/2011 | Peterson | |
| 2011/0286897 | A1 | 11/2011 | Uschkureit et al. | |
| 2011/0300037 | A1 | 12/2011 | Liu et al. | |
| 2013/0309147 | A1 | 11/2013 | Yu | |
| 2013/0314697 | A1* | 11/2013 | Voit | G01N 21/0303 356/51 |
| 2014/0271408 | A1* | 9/2014 | Taunk | B01L 3/50825 422/550 |
| 2014/0363885 | A1 | 12/2014 | Day et al. | |
| 2016/0107158 | A1* | 4/2016 | Gray | B01L 3/5082 73/864.91 |
| 2016/0243734 | A1 | 8/2016 | Pitzek et al. | |
| 2018/0169650 | A1 | 6/2018 | Somada et al. | |

* cited by examiner

REPLACEMENT SHEET

MULTI-COMPONENT SAMPLE HOLDER

RELATED APPLICATION

This application claims priority under 35 U.S.C. § 119(e) to U.S. Provisional Application Ser. No. 62/990,680, entitled "MULTI-COMPONENT SAMPLE HOLDER," filed Mar. 17, 2020, which is herein incorporated by reference in its entirety.

BACKGROUND

1. Field of Invention

Methods and apparatus for sample holders, including individual vessels and multiwell plates are described.

2. Related Art

Sample holders, including individual tubes or vessels, as well as vessels in multi-well plates, sometimes called microtiter plates or microplates, are widely used in laboratory and other applications for holding and processing liquid samples, e.g., for diagnostic testing and research. Such vessels are used to expose a sample to a variety of different treatments, including exposure to sonic energy, heat/cooling cycles such as that used in PCR processing, and others.

SUMMARY

The inventors have appreciated that while sample vessels are formed of materials that are suitable for certain treatment applications, such as heating/cooling cycles used in PCR processing, thermal digestion, thermal dissolution, thermal separation, and incubation, such materials are not suitable and/or ideal for other applications, such as heat sealing closed the vessel opening. Aspects of the invention provide sample vessels that incorporate two or more different materials, e.g., to allow the vessels to provide high performance functionality for two or more purposes. In some embodiments, sample vessels may include a first material suitable for acoustic treatment and/or thermal cycling, and a second material suitable for applying a heat-sealed film or other cover to vessel opening. In some cases, the first material may form a lower part of the vessel, e.g., where a liquid sample is held, and the second material may form an upper part of the vessel, e.g., a rim that defines an upper opening to the interior space of the vessel. (As used herein, a "rim" refers to the extreme upper end of a vessel that defines an opening to the vessel interior, but does not require any particular shape or size. For example, a rim of a vessel may define a circular, oval, square or other opening to a vessel interior space. Also, use of "first," "second," "third" etc. simply designates different material types and is not intended to an order of manufacture (e.g., "first material" is used first, and so on) or relative importance.) The first and second material portions may be joined so as to form a single unitary part for the vessel, e.g., the first and second material portions may be co-molded, welded, joined by adhesive, etc., and may not be separable from each other without damaging the vessel.

In one aspect of the invention, a sample holder for holding a liquid sample for laboratory processing includes at least one vessel having a bottom and sidewall defining an interior volume and a rim defining an opening to the interior volume. The at least one vessel includes a first portion that defines at least a part of the bottom and sidewall and is made of a first material, and a second portion that defines the rim and is made of a second material different from the first material. The first material may be suitable for treating a sample held in the interior volume with heating and cooling cycles (such as that used for PCR processing or other applications involving heating/cooling of a sample) and/or for acoustic energy treatment of the sample, and the second material may be adapted to form a seal with a heat sealing or adhesive film to close the opening of the vessel. In some cases, the first portion defines 50% to 95% of the interior volume, i.e., a majority of the interior volume of the vessel while the second portion may define little or none of the interior volume. In other cases, the first portion defines 5% to 50% of the interior volume, and the second portion may define a large part of the interior volume. The first and second portion may be secured together in any suitable way, e.g., the second portion may be overmolded onto the first portion, or the first portion may be overmolded onto the second portion, to form the vessel. The first portion may have a radially extending flange, e.g., to support the vessel, and the second portion may be positioned above the radially extending flange. Alternately, the second portion may include a radially extending flange. In some embodiments, the second portion may have an annular shape with inner and outer surfaces, and the second portion may be attached to the first portion such that the inner surface of the second portion meets an inner surface of the first portion. The meeting or transition of the inner surface of the second portion to the first portion may be smooth and continuous, or may be discontinuous, e.g., stepped, angular, etc.

The sample holder may include a plurality of vessels arranged in an array on a vessel support. The vessel support may be made of the first material, the second material, or a third material that is different from both the first and second materials. In some cases, the vessel support includes a support plate with a plurality of vessel openings, and the first portion of each of the plurality of vessels is positioned in a corresponding one of the plurality of vessel openings. For example, each of the plurality of vessels may have a lower part that is inserted into a vessel opening and a radially extending flange that is positioned on the support plate adjacent the vessel opening in which the vessel is positioned. A retainer having a plurality of retainer openings may be positioned over the support plate with each of the plurality of vessels positioned in a corresponding retainer opening such that the radially extending flange is between the retainer and the support plate. This may capture or otherwise retain the vessels on the support plate. The second portion of each of the plurality of vessels may be positioned above the radially extending flange and at least partially within a corresponding retainer opening, e.g., so the rim of the second portion of each of the plurality of vessels is positioned above an uppermost surface of the retainer. This may aid in providing a heat sealed film or other closure onto the rims of the vessels. The vessel support may include a skirt that extends downwardly from the support plate, e.g., below the bottoms of the vessels so the vessels can be supported by the vessel support above a surface on which the sample holder is placed. Thus, the sample holder may have a plurality of vessels arranged so the rims of each of the plurality of vessels is positioned above an uppermost surface of the vessel support, and so that the first portion of each of the vessels extends below the support plate. In some embodiments, the second portion of each vessel may include an integral cap, e.g., attached by a living hinge to the second portion, that can be used to cover the opening of the vessel.

Other advantages and novel features of the invention will become apparent from the following detailed description of various non-limiting embodiments when considered in conjunction with the accompanying figures and claims.

BRIEF DESCRIPTION OF THE DRAWINGS

Aspects of the invention are described with reference to the following drawings in which numerals reference like elements, and wherein.

DETAILED DESCRIPTION

Figure 1:
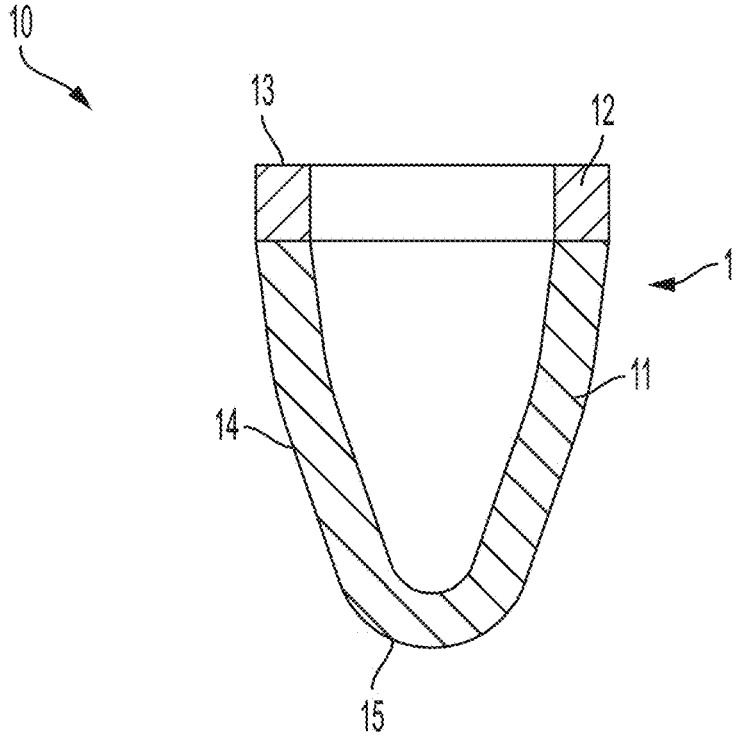
FIG. 1 is cross sectional view of a sample holder vessel in an illustrative embodiment.

FIG. 1 shows an illustrative embodiment of a sample holder 10 including a vessel 1 having first and second portions 11, 12. The vessel 1 has a rim 13 that defines an opening to the interior volume of the vessel, a sidewall 14 that extends from the rim 13 and a bottom 15. The first portion 11 of the vessel 1 defines a portion of the sidewall 14 and bottom 15, and thus defines at least a portion of the interior volume of the vessel 1. The second portion 12 defines the rim 13 and may define a part of the sidewall 14 and/or other vessel parts. Thus, the second portion 12 may define a portion of the interior volume of the vessel 1, but need not do so. The first and second portions 11, 12 may be made of different materials, and so give the vessel 1 capabilities a single-material vessel does not have. For example, polymethylpentene or polycarbonate materials can provide a vessel with good suitability for use in thermal cycling treatment (e.g., as used in PCR processing or other thermal applications) and/or focused acoustic energy treatment, such as is done with Covaris acoustic treatment instruments (Covaris, Woburn Ma.), or other sonication processes. However, while such materials have excellent properties for thermal cycling (e.g., to withstand multiple, wide temperature variations without vessel warping or damage) and acoustic treatment (e.g., having a low acoustic impedance or otherwise have an ability to transmit acoustic energy with high efficiency), these materials may lack other capabilities, such as forming a suitably robust seal with a heat sealing or other film. Thus, vessels made with polymethylpentene, polycarbonate, and/or other materials often cannot be used with commercial heat sealing tools that use heat to seal a film to the vessel opening. Instead, these vessels must be closed in some other way, such as by a friction fit cap or lid that is held in place by a clip or other fastener. In the embodiment of FIG. 1, the first portion 11 of the vessel 1 may be made of polymethylpentene, polycarbonate, Low Density Polyethylene (LDP), High Density Polyethylene (HDP), Liquid Crystal Polymer (LCP), Cyclic Olefin Copolymer (COC), and/or Cyclic Olefin Polymer (COP) materials (or others) that provide a desired performance for acoustic energy treatment or other processing conditions, and the second portion 12 can be made of a polypropylene material (or others) to provide the ability to apply a heat sealed film to the rim 13, and thus seal the interior space of the vessel closed. This is merely one example, and other material combinations or arrangements are possible, depending on the desired vessel characteristics. Other materials that may be used for the first and/or second portions include cyclic olefin polymer (COP) materials, cyclic olefin copolymer (COC) materials, styrene, polyethylene, silicone, and amorphous thermoplastic polyimide materials. For example, in another application, it may be desirable to have the lower part of the vessel 1 made of glass, yet still retain the ability to provide a heat sealing film closure at the vessel opening, which is not typically possible with a glass tube. The upper part of the vessel may be made of polypropylene as described above so that a heat sealed closure can be provided. As another example, the second material may be one that is more suitable for providing a cap that is integral with the second portion, e.g., connected by a living hinge. In such a case, the second portion may be made of a polyethylene or polypropylene material including a living hinge and cap made unitarily with the second portion that forms the rim. This may help keep caps from being lost or in place. For example, each vessel in a multiwell plate may have its own integral cap attached to the second portion. Caps for individual vessels may be removed for placement/removal of sample with respect to the vessel while caps for other vessels remain in place, closing the corresponding vessel. This may help prevent cross contamination or help ensure that a sample is loaded into the proper vessel. The first and second portions 11, 12 may be attached together in any suitable way. For example, in the FIG. 1 embodiment, the second portion 12 may be overmolded onto a pre-formed first portion 11, or the first portion 11 may be overmolded onto a pre-formed second portion 12. Alternately, the first and second portions 11, 12 may be joined by welding, adhesive, a threaded engagement, interference fit, etc.

In the embodiment of FIG. 1, the vessel 1 has a generally conical shape with a tapering lower portion and rounded bottom. While this shape may be suitable for some applications, other vessel shapes are possible. For example, the sidewall 14 may be cylindrical, a square tube, or a combination of cylindrical and conical in shape, the bottom 15 may be flat, spherical, or otherwise arranged, and so on. Thus, the vessel shape, and particularly the shape of the sidewall 14 and bottom 15 are not critical to all embodiments. In at least some embodiments, the vessel defines an interior volume that is not collapsible. That is, the sidewall 14 and bottom 15 of the vessel may be rigid, resilient or otherwise tend to hold their shape as opposed to a flexible bag, bellows or other collapsible container arrangement.

Figure 2:
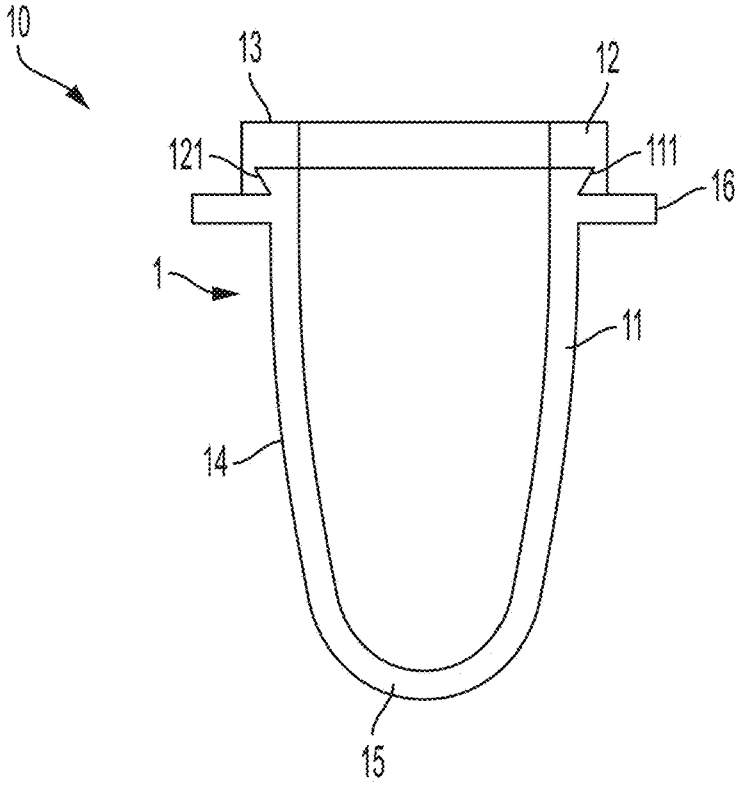
FIG. 2 is a cross sectional view of a sample holder vessel in another embodiment in which the vessel includes a flange.

FIG. 2 shows another illustrative embodiment of a vessel 1 that has a first portion 11 that includes a radially extending flange 16, e.g., which may be used to support the vessel 1. The flange 16 may provide a gripping surface for a user to hold the vessel 1, and/or the flange 16 may be engaged with a vessel holder so the vessel holder can support the vessel 1. Options regarding vessel holder arrangements are discussed more below. While in this embodiment the flange 16 has a continuous annular shape, the flange 16 may be arranged in other ways, e.g., including one or more separate tabs, pins or fins that extend outwardly from the sidewall 14. In this embodiment, the second portion 12 of the vessel 1 is secured to the first portion 11 above the flange 16, which is formed as part of the first portion 11. However, the flange 16 could be formed as part of the second portion 12 and/or the second portion 12 may be attached to the first portion 11 at a location below the flange 16. Note also that the flange 16 could be formed as an element separate from the first and second portions 11, 12, and attached to the first and/or second portion 11, 12. In this embodiment, the second portion 12 is attached to the first portion 11 by overmolding the second portion 12 onto the first portion 11. That is, the first portion 11 is initially formed as a complete element, e.g., by injection molding or other suitable process. The second portion 12 may be molded onto the first portion 11, e.g., by injection molding, or otherwise attached to the first portion 11 by welding, adhesive, etc. However, this process may be reversed with the first portion 11 molded onto the second portion 12. In the FIG. 2 embodiment, the upper part of the first portion 11 has a collar with a bevel or chamfer 111 that tapers radially upwardly and outwardly. This bevel or chamfer 111 can be engaged by a corresponding tooth or lip 121 of the second portion 12, and may aid in engagement of the second portion 12 with the first portion 11. For example, the second portion 12 may be snapped onto the first portion 11 and engaged by interference fit rather than engaged by overmolding, adhesive, etc. Another option is to threadedly engage the second portion 12 with the first portion 11.

In the FIG. 2 embodiment, the first portion 11 defines 50% to 95% of the interior volume. Thus, a liquid sample held in the interior volume of the vessel 1 may contact only the inner surface of the first portion 11. Other alternatives are possible, though, such as the first portion defining 5% to 50% of the interior volume and the second portion 12 may define a majority or more of the interior volume of the vessel 1. Having the first portion 11 define a majority or more of the vessel interior volume may provide advantages, e.g., where the vessel 1 is used to expose a sample to heating and/or cooling cycles. In such a case, the first portion 11 may be made of a material suitable to withstand large temperature variations, e.g., from −50 degrees C. to 150 degrees C. or more without deforming or otherwise being damaged or changed by the temperature changes. The second material 12 need not necessarily be made of a material that can withstand such temperature variations, e.g., without deforming or losing shape because the second portion 12 may rely on the first portion 11 for physical support. As another example, the vessel 1 may be used to expose a sample to focused acoustic energy, and the first portion 11 may be made of a material that provides suitably efficient transmission of acoustic energy, including a material that transmits acoustic energy more efficiently than a second material used to form the second portion 12. Since acoustic energy need not be transmitted through the second material, the second portion 12 may be opaque to acoustic energy or otherwise have a poor efficiency for acoustic energy transmission. In some embodiments, the second material used to form the second portion 12 may be adapted to form a seal with a heat sealing film to close the opening of the vessel. Materials suitable for a heat sealing operation, such as polypropylene, may not be particularly suited for thermal cycling and/or acoustic energy treatment, but poor material characteristics for these applications may have little or no effect on performance of the vessel 1 because the first portion 11 may be made of a first material that is well suited to the desired treatment.

In the FIG. 2 embodiment, the second portion 12 has an annular shape with inner and outer surfaces, and the second portion 12 is arranged with respect to the first portion 11 such that the inner surface of the second portion 12 meets or transitions to an inner surface of the first portion 11. For example, in some embodiments the transition between the first and second portions 11, 12 may be smooth, e.g., in the plane of FIG. 2, a line tangent to the inner surface of the first portion 11 at or near a point of the transition may have a same slope as a line tangent to the inner surface of the second portion 12 at or near the same point of the transition. In other arrangements, the transition at the inner surfaces of the first and second portions 11, 12 may be discontinuous, e.g., a step or angular junction may be formed where the first and second portions 11, 12 meet. As an example, the inner surface of the second portion 12 may be conical so the inner surface of the second portion 12 tapers from a wider size at an upper end of the second portion 12 to a smaller size where the second portion 12 transitions to the first portion 11. The inner surface of the first portion may be cylindrical or conical but with a steeper taper angle than the inner surface of the second portion 12.

Figure 3:
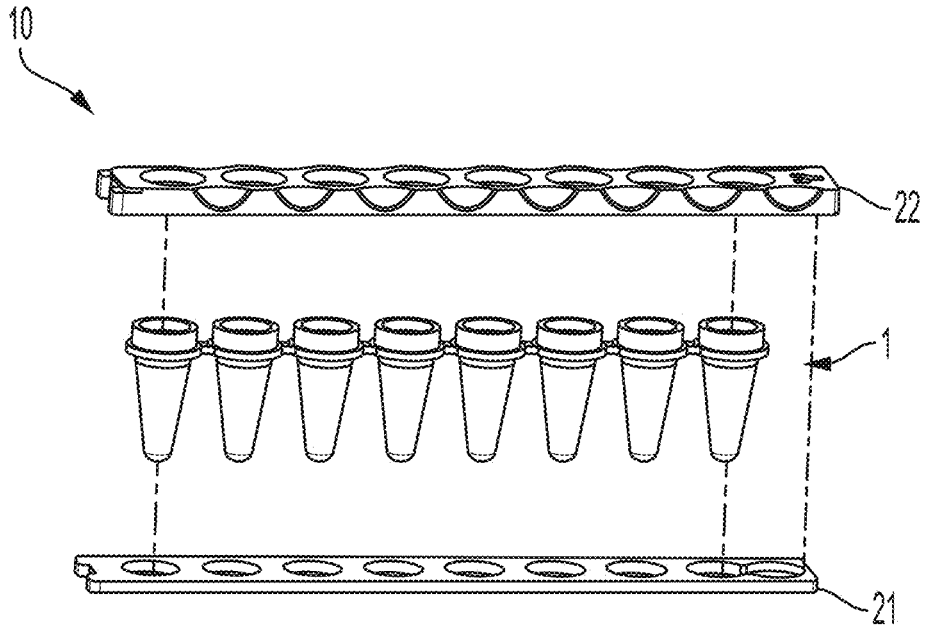
FIG. 3 is an exploded view of a sample holder having an array of vessels and a vessel support in an illustrative embodiment.
Figure 4:
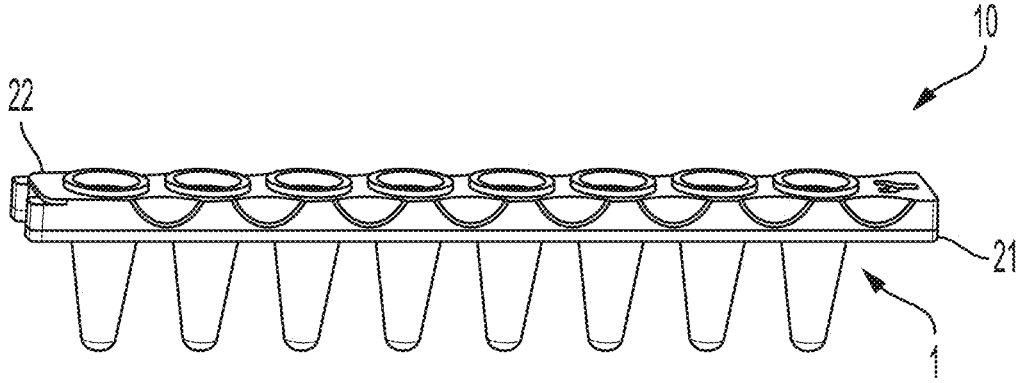
FIG. 4 shows the FIG. 3 embodiment in an assembled condition.

As mentioned above, some embodiments of a sample holder 10 may include a plurality of vessels 1, e.g., arranged in an array on a vessel support. FIGS. 3 and 4 show one illustrative arrangement in which a plurality of vessels 1 are supported by a vessel support that includes a support plate 21 and a retainer 22. The support plate 21 may include a plurality of vessel openings that each receives a corresponding vessel 1. With the vessels 1 received in the vessel openings of the support plate 21, the retainer 22 may be positioned over the vessels 1 to retain the vessels 1 in place on the support plate 21. For example, the vessels 1 may be arranged as in FIG. 2 having a radially extending flange 16. The flange 16 may have a size that is larger than the corresponding vessel opening on the support plate 21 so that when the lower part of the vessel 1 is positioned in the vessel opening, the vessel 1 is supported by the flange 16 on the support plate 21. The retainer 22 may have retainer openings arranged to fit over the second portion 12 of corresponding vessels and capture or otherwise retain the flange 16 between the retainer 22 and the support plate 21. In some cases the rim 13 of the second portion 12 may be positioned above the retainer 22, e.g., to allow suitable ability to apply a heat sealed film to the rim 13. Alternately, the rim 13 may be positioned at or below the upper surface of the retainer 22. Other arrangements for the vessel support are possible, e.g., the support plate 21 may be used alone and without the retainer 22 and vessels 1 may engage the support plate 21 by friction fit, adhesive, welding, etc. In another arrangement, the flanges 16 of the vessels 1 may be secured together to form a support plate 21, e.g., by molding the first portions 11 and flanges 16 of multiple vessels 1 as one piece. Note also that even if a separate support plate 21 is used, multiple vessels 1 may be formed as a single unitary part or otherwise integrally, e.g., with flanges 16 attached together as an aid to assembly of an array of vessels with a support plate 21. The vessel support, including the support plate 21 and/or the retainer 22 may be made of a same material as the first portion 11, the same as the second portion 12, or a different material than either the first or second portions 11, 12. As an example, the first portion 11 may be made of a polymethylpentene material, the second portion 12 may be made of a polypropylene material, and the vessel support may be made of a polycarbonate material.

Figure 5:
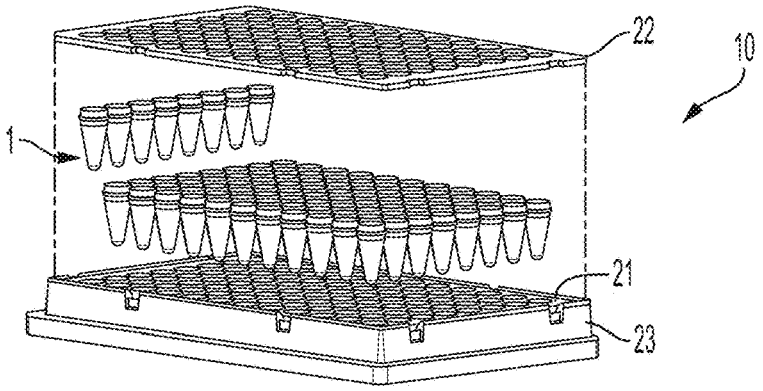
FIG. 5 is an exploded view of a sample holder having an array of vessels and a vessel support in another embodiment.
Figure 6:
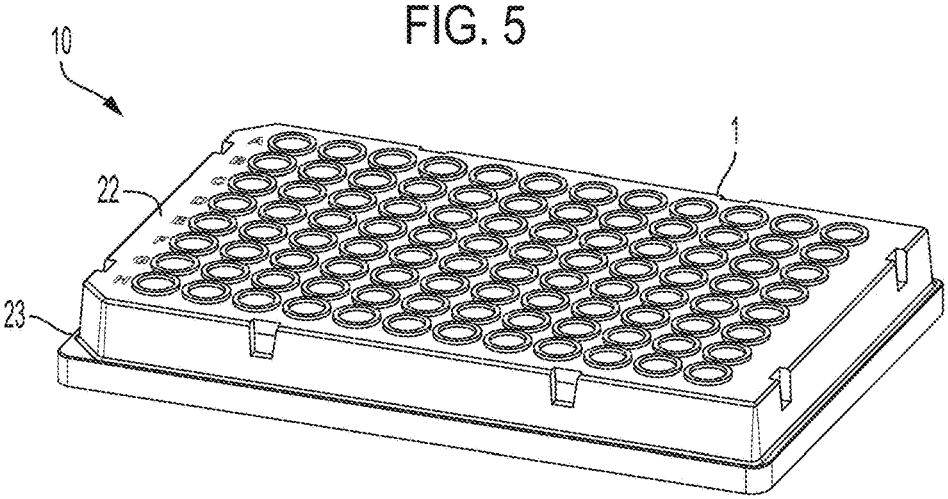
FIG. 6 shows the FIG. 5 embodiment in an assembled condition.
Figure 7:
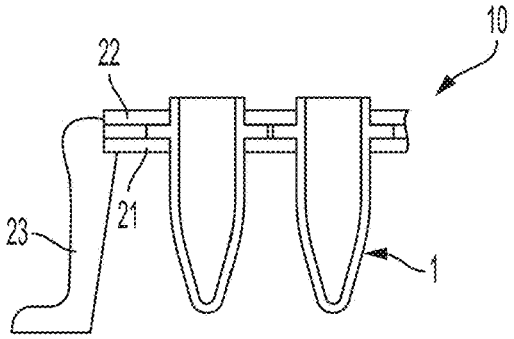
FIG. 7 shows a cross section of a portion of the FIG. 5 sample holder.

While FIGS. 3 and 4 show a sample holder 10 with a linear array of vessels 1, other arrangements are possible. For example, FIGS. 5-7 show an embodiment with a two dimensional array of vessels 1, e.g., in a standard 96 well format used with some multi-well plates. As with the FIGS. 3 and 4 embodiment, the FIGS. 5-7 embodiment may have a support plate 21 with a plurality of vessel openings to receive a corresponding vessel 1, each of which may be made as in the FIG. 2 embodiment. A retainer 22 may have retainer openings that fit over and receive a corresponding second portion 12 of a vessel 1. The retainer 22 may be secured to the support plate 21 to capture or otherwise retain the vessels 1 to the vessel support. As discussed above, the retainer 22 is not required, and vessels 1 may be secured to the support plate 21 by friction fit, co-molding, welding, etc. Also, the support plate 21 may be molded together with the first and/or second portion 11, 12 of a plurality of vessels 1. The rims 13 of the second portions 12 of the vessels 1 may be positioned above an uppermost surface of the vessel support, e.g., of the retainer 22 or support plate 21 to allow application of a heat sealed film to the rims 13. In another embodiment, the second portions 12 may each have an integrally formed cap, e.g., attached by a living hinge that can selectively cover and seal or uncover the opening to the vessel. The vessel support in FIGS. 5-7 also includes a skirt 23, i.e., one or more walls that extend downwardly from the support plate 21. The skirt 23 may be made unitarily with the support plate 21, or may be made separately and attached to the support plate 21, e.g., where flanges 16 of vessels 1 are attached together to form a support plate 21, which is attached to a separately formed skirt 23. The skirt 23, support plate 21, first and second portions 11, 12, and retainer 22 may be made of different materials from each other, or of the same materials. The skirt 23 can be arranged to extend downwardly from the support plate below the bottoms of the vessels so that the bottoms of the vessels 1 can be supported by the skirt 23 above an underlying surface, such as a table top. This can help avoid damage to the bottoms of the vessels 1. Of course, the skirt 23 is not required or may extend downwardly a relatively short distance from the support plate 21 that is less than the distance the vessels 1 extend downwardly below the support plate 21. The skirt 23 can provide different functions, including providing a gripping surface for a person or automated plate handler to pick and move the sample holder 10, providing strength or rigidity to the sample holder 10 (e.g., to help resist bending or warping caused by physical contact or heating of the sample holder 10), and/or supporting the sample holder 10 on a flat support surface such as a table top while holding the vessels 1 above the support surface.

In some embodiments, sample holders 10 and/or individual vessels 1 may be provided with an RFID tag or other machine readable feature. The machine readable feature may provide various functions including the ability to read and identify a holder or a sample held by the holder (e.g., how many wells on a multiwell plate, what materials are used to form the holder, what processes the holder can support, what types of samples are held by the holder, etc.) and thus help an automated processing system determine what processing conditions are appropriate. The machine readable feature may also store process information for chain of custody and use of the holder and its contents, and/or offer users the ability to track the holder and/or sample in a lab workflow and then transfer, as desired, information stored on the RFID tag into a LIMS or other electronic record keeping system.

While aspects of the invention have been described with reference to various illustrative embodiments, such aspects are not limited to the embodiments described. Thus, it is evident that many alternatives, modifications, and variations of the embodiments described will be apparent to those skilled in the art. Accordingly, embodiments as set forth herein are intended to be illustrative, not limiting. Various changes may be made without departing from the spirit of aspects of the invention.

The invention claimed is:

1. A sample holder for holding a liquid sample for laboratory processing, the sample holder comprising:

a vessel having a bottom and sidewall defining an interior volume and a rim defining an opening to the interior volume, each vessel having a first portion that is made of a first material and defines at least the bottom, the sidewall and a flange having a continuous annular shape that extends radially outwardly from the sidewall and is configured to engage with a vessel support to support the vessel on the vessel support, and a second portion that defines the rim, is positioned above the flange and is made of a second material different from the first material, wherein the flange extends outwardly from the sidewall to a greater extent than any part of the second portion extends outwardly from the sidewall.

2. The sample holder of claim 1, wherein the first portion defines 50% to 95% of the interior volume.

3. The sample holder of claim 1, wherein the first material is suitable for treating a sample held in the interior volume with heating and cooling cycles of PCR processing.

4. The sample holder of claim 1, wherein the first material transmits acoustic energy more efficiently than the second material.

5. The sample holder of claim 1, wherein the second material is adapted to form a seal with a heat sealing film to close the opening of the vessel.

6. The sample holder of claim 1, wherein the second portion is overmolded onto the first portion to form the vessel.

7. The sample holder of claim 1, wherein the second portion has an annular shape with inner and outer surfaces, and the second portion is attached to the first portion such that the inner surface of the second portion meets an inner surface of the first portion so as to make a smooth transition.

8. The sample holder of claim 1, comprising a plurality of the one vessels arranged in an array on a vessel support.

9. A sample holder for holding a liquid sample for laboratory processing, the sample holder comprising:

a plurality of vessels arranged in an array on a vessel support, each vessel having a bottom and sidewall defining an interior volume and a rim defining an opening to the interior volume, each vessel having a first portion that is made of a first material and defines at least the bottom, the sidewall and a flange that extends outwardly from the sidewall and is configured to engage with the vessel support to support the vessel on the vessel support, and a second portion that defines the rim, is positioned above the flange and is made of a second material different from the first material, wherein the vessel support is made of the first material.

10. A sample holder for holding a liquid sample for laboratory processing, the sample holder comprising:

a plurality of vessels arranged in an array on a vessel support, each vessel having a bottom and sidewall defining an interior volume and a rim defining an opening to the interior volume, each vessel having a first portion that is made of a first material and defines at least the bottom, the sidewall and a flange that extends outwardly from the sidewall and is configured to engage with the vessel support to support the vessel on the vessel support, and a second portion that defines the rim, is positioned above the flange and is made of a second material different from the first material, wherein the vessel support is made of a third material different from the first and second materials.

11. The sample holder of claim 8, wherein the vessel support includes a support plate with a plurality of vessel openings, and wherein the first portion of each of the plurality of the vessels is positioned in a corresponding one of the plurality of vessel openings.

12. The sample holder of claim 11, wherein the flange of each of the plurality of vessels is positioned on the support plate adjacent the vessel opening in which the at least one vessel is positioned.

13. The sample holder of claim 12, further comprising a retainer having a plurality of retainer openings, the retainer being positioned over the support plate with each of the plurality of vessels positioned in a corresponding retainer opening such that the flange is between the retainer and the support plate.

14. The sample holder of claim 13, wherein the second portion of each of the plurality of vessels is positioned above the flange and at least partially within a corresponding retainer opening.

15. The sample holder of claim 14, wherein the rim of the second portion of each of the plurality of vessels is positioned above an uppermost surface of the retainer.

16. The sample holder of claim 11, wherein the vessel support includes a skirt that extends downwardly from the support plate further than the plurality of vessels extend downwardly from the support plate.

17. The sample holder of claim 16, wherein the vessel support is made of a third material different from the first and second materials.

18. The sample holder of claim 1, wherein the vessel has an interior volume of no more than 10 ml.

19. The sample holder of claim 1, wherein the first material is polymethylpentene and the second material is polypropylene.

20. The sample holder of claim 1, comprising a plurality of the vessels arranged in an array on a vessel support, the vessel support having an uppermost surface and the rims of each of the plurality of vessels being positioned above the uppermost surface of the vessel support.

21. The sample holder of claim 20, wherein the vessel support includes a support plate with a plurality of vessel openings, each of the plurality of vessels being positioned in a corresponding one of the plurality of vessel openings so that the first portion extends below the support plate and the second portion extends above the uppermost surface of the support plate.

22. The sample holder of claim 21, wherein the vessel support includes a skirt that extends downwardly from the support plate further than the plurality of vessels extend downwardly from the support plate.

23. The sample holder of claim 1, comprising a plurality of the vessels arranged in an array on a vessel support, the vessel support including a support plate with a plurality of vessel openings, each of the plurality of vessels being positioned in a corresponding one of the plurality of vessel openings, and wherein an underside of the flange of each of the plurality of vessels is positioned on an upper side the support plate adjacent the vessel opening in which the vessel is positioned.

24. The sample holder of claim 1, wherein the first portion defines 5% to 50% of the interior volume.

25. A sample holder for holding a liquid sample for laboratory processing, the sample holder comprising:

a vessel support including a support plate with a plurality of vessel openings;

a plurality of vessels arranged in an array on the vessel support, each of the plurality of vessels having a bottom and sidewall defining an interior volume and a rim defining an opening to the interior volume, each of the plurality of vessels having a first portion that defines at least a part of the bottom and sidewall and is made of a first material, and a second portion that defines the rim and is made of a second material different from the first material, wherein the first portion of each of the plurality of vessels is positioned in a corresponding one of the plurality of vessel openings such that a radially extending flange disposed on the vessel is positioned on the support plate adjacent to the vessel opening in which the vessel is positioned; and a retainer having a plurality of retainer openings, the retainer being positioned over the support plate with each of the plurality of vessels positioned in a corresponding retainer opening such that the radially extending flange is between the retainer and the support plate, wherein the second portion of each of the plurality of vessels is positioned at least partially within a corresponding retainer opening and the rim of the second portion of each of the plurality of vessels is positioned above an uppermost surface of the retainer.

26. A sample holder for holding a liquid sample for laboratory processing, the sample holder comprising:

a vessel support including a support plate with a plurality of vessel openings; and a plurality of vessels arranged in an array on the vessel support, each vessel having a bottom and sidewall defining an interior volume and a rim defining an opening to the interior volume, each vessel having a first portion that is made of a first material and defines at least the bottom, the sidewall and a flange that extends outwardly from the sidewall and is configured to engage with a vessel support to support the vessel on the vessel support, and a second portion that defines the rim, is positioned over the flange and is made of a second material different from the first material, wherein the first portion of each of the plurality of vessels is positioned in a corresponding one of the plurality of vessel openings, and wherein an underside of the flange of each of the plurality of vessels is positioned on an upper side the support plate adjacent the vessel opening in which the vessel is positioned.

* * * * *